US008832969B2

(12) United States Patent
Orvitz

(10) Patent No.: US 8,832,969 B2
(45) **Date of Patent: *Sep. 16, 2014**

(54) ORTHOPEDIC FOOT APPLIANCE

(76) Inventor: Kevan Orvitz, Irvine, CA (US)

( * ) Notice: Subject to any disclaimer, the term of this patent is extended or adjusted under 35 U.S.C. 154(b) by 394 days.

This patent is subject to a terminal disclaimer.

(21) Appl. No.: 12/329,723

(22) Filed: Dec. 8, 2008

(65) Prior Publication Data

US 2009/0094861 A1 Apr. 16, 2009

Related U.S. Application Data

(63) Continuation-in-part of application No. PCT/IL2007/000698, filed on Jun. 10, 2007.

(60) Provisional application No. 60/812,094, filed on Jun. 9, 2006.

(51) Int. Cl.

| | |
|---|---|
| ***A43B 13/38*** | (2006.01) |
| ***A43B 17/18*** | (2006.01) |
| ***A43B 13/12*** | (2006.01) |
| ***A43B 7/14*** | (2006.01) |
| ***A43B 1/00*** | (2006.01) |

(52) U.S. Cl.

CPC ..... *A43B 17/18* (2013.01); *A43B 13/12* (2013.01); *A43B 7/141* (2013.01); *A43B 1/0081* (2013.01); *A43B 7/142* (2013.01); *A43B 7/144* (2013.01); *A43B 7/1465* (2013.01)

USPC ..... 36/44; 36/174; 36/180; 36/100

(58) Field of Classification Search

CPC ..... A43B 7/14; A43B 7/141; A43B 13/12; A43B 13/38; A43B 17/16; A43B 17/14; A43B 17/02; A43B 17/00

USPC ..... 36/43, 44, 71, 173, 174, 145, 180, 92

See application file for complete search history.

(56) References Cited

U.S. PATENT DOCUMENTS

| | | | | |
|---|---|---|---|---|
| 2,227,429 | A | 1/1941 | Austin | |
| 3,529,368 | A * | 9/1970 | Canfield | 36/117.9 |
| 3,922,800 | A * | 12/1975 | Miller et al. | 36/117.5 |
| 4,019,266 | A * | 4/1977 | Hanson et al. | 36/117.6 |
| 4,263,727 | A * | 4/1981 | Bender et al. | 36/44 |
| 4,590,689 | A * | 5/1986 | Rosenberg | 36/3 B |
| 4,823,483 | A | 4/1989 | Chapnick | |
| 4,879,821 | A * | 11/1989 | Graham et al. | 36/44 |
| 5,146,698 | A * | 9/1992 | Tilles et al. | 36/44 |
| 5,727,336 | A * | 3/1998 | Ogden | 36/43 |
| 6,205,685 | B1 * | 3/2001 | Kellerman | 36/44 |
| 6,233,847 | B1 | 5/2001 | Brown | |
| 6,481,120 | B1 * | 11/2002 | Xia et al. | 36/44 |

(Continued)

*Primary Examiner* — Jila M Mohandesi

(74) *Attorney, Agent, or Firm* — AlphaPatent Associates Ltd.; Daniel J. Swirsky

(57) ABSTRACT

An orthopedic foot appliance providing optimal and adaptable comfort and shock absorption while at the same time varying degrees of heel support, arch support and motion control depending on the foot type and footwear. The orthopedic foot appliance consists of a cushioning insole and a re-attachable support piece for attaching and re-attaching to the insole. The insole includes a trim line allowing the insole to be adapted to a three quarters length of a full insole. The three quarters length may extend form from the back of the heel to the metatarsal heads. The support component may be constructed from any of a group of materials including polyethylene, polypropylene and polypropylene incorporating glass or silica.

18 Claims, 4 Drawing Sheets

(56) References Cited

U.S. PATENT DOCUMENTS

| | | | | |
|---|---|---|---|---|
| 6,557,273 | B2 | 5/2003 | Polifroni | |
| 6,618,960 | B2 * | 9/2003 | Brown | 36/44 |
| 6,662,469 | B2 * | 12/2003 | Belley et al. | 36/16 |
| 7,231,728 | B2 * | 6/2007 | Darby | 36/110 |
| 7,284,342 | B2 * | 10/2007 | Avent et al. | 36/44 |
| 7,721,467 | B2 * | 5/2010 | Cheskin et al. | 36/44 |
| 2001/0001351 | A1 * | 5/2001 | Dieckhaus | 36/44 |
| 2004/0118017 | A1 * | 6/2004 | Dalton et al. | 36/44 |
| 2004/0181971 | A1 | 9/2004 | Turkbas et al. | |
| 2006/0026866 | A1 | 2/2006 | Avent et al. | |

* cited by examiner

ORTHOPEDIC FOOT APPLIANCE

CROSS-REFERENCE TO RELATED APPLICATIONS

This application is a Continuation-in-Part Application of PCT International Application No. PCT/IL2007/000698, which has an international filing date of Jun. 10, 2007, and which claims priority from U.S. Provisional Patent Application No. 60/812,094, filed Jun. 9, 2006, both of which are incorporated herein by reference in their entirety.

FIELD OF THE INVENTION

The present invention relates generally to shoe insoles or foot orthotic and footwear inserts, and more particularly, to an orthopedic foot appliance providing a combination of self customized optimal cushioning and support.

BACKGROUND OF THE INVENTION

The feet are the foundation and base of support for the entire body, whether standing walking or running. As a result they help protect your bones soft tissue and spine from misalignment and damaging shock forces from the ground. Any weakness, instability or lack of shock absorption in the feet can contribute to postural and stress problems throughout the rest of the body which can lead to knee, hip and back and even shoulder and neck pain.

In the US, foot and foot-related problems affect over 75% of the population. One in six people (43 million people) have moderate-to-severe foot problems. These foot problems cost the US economy about $3.5 Billion/year. Additionally, 16 million people in the US have diabetes, and are very susceptible to problems of the feet. Further, the average age of the US population is continuing to increase. As individuals age, they are increasingly exposed to additional problems resulting from natural, physiological and biomechanical changes such as increasing foot sizes, and various degenerative diseases. The foot continues to change throughout a person's lifetime. With aging, the width and length of the foot often grow by one or more sizes. Collapsing of the arch is also a common occurrence.

As people age there also is a thinning of fat pad tissue of the bottom of the feet. This results in a lack of cushioning and shock absorption leading to increased pain and discomfort. When coupled with certain diseases such as diabetes, this condition can lead to ulceration, loss of limb, or loss of life. Additionally, aging usually results in an increase in body weight which further stresses the skeletal structure. Most people take 8,000 to 10,000 steps per day, which adds up to over 100,000 miles in a lifetime—more than four times the circumference of the earth. The pressure on your feet when walking can exceeds your total body weight, and when you're running, it can be three or four times your weight.

There has also been a trend recently towards more healthy living which has led large numbers of people to undertake daily or frequent walking, running and jogging routines. These usually result in a significant increase in the level of strain placed on the feet.

Since we stand and walk with our feet in contact with the ground, we need to understand the many factors that will impact levels of pain and discomfort while standing or walking for long periods of time such as at the work place.

The weight bearing portion of the body while in the standing position is the foot. This also represents the foundation upon which the knee, hip and back will be affected long term.

As the heel contacts the ground, there is an equal but opposite reaction force from the ground on the calcaneus (heel bone). As a result there is a twisting of the tibial (leg) bone in an inward direction. This forces the arch of the foot lower, making the leg and foot muscles work harder, causing increased muscle fatigue. As a result, any lack of support at the level of the foot will cause the legs to roll inwards and the arch to collapse even further as the work shift progresses. This will cause the hips to tilt anterior & result in a 15 degree trunk forward lean. Knees and hips will also experience more inward stress and strain over time. The back muscles will also be forced to work even harder to keep the worker standing upright At the same time any lack of shock absorption at the level of the feet allows the force from heel strike to make its way up the body like a shock wave with every step. The harder and more unforgiving the floor or ground surface the greater the shock wave. All the joints and muscles from the ankles to the knees to the hips and the back will feel the effects of this added pounding.

Decrease in blood circulation as a result of prolonged static standing can also lead to swelling of the legs, varicose veins, cramping and increased muscle fatigue and discomfort. The effects aging when added to the equation can also result in arthritis and other degenerative diseases as well as other systemic disorders and medical conditions.

According to Joseph Pine, his book "Mass Customization, The New Frontier in Business Competition.": 'the mass production of standardized goods was the source of America's economic strength for generations. But in today's turbulent business environment mass production no longer works; in fact, it has become a major cause of the nation's declining competitiveness.' As Pine makes clear, the most innovative companies are rapidly embracing a new management paradigm—"mass customization"—which allows them the freedom to create greater variety and individuality in their products and services at desirable prices.

Instinctively, these firms understand that they must adhere to this premise or risk extinction. However, most are simply unwilling or unable to take the necessary action.

In general, mass-produced footwear is often quite uncomfortable, even if perfectly sized. People who value comfort have usually resorted to purchasing specialized more expensive "orthopedic" shoes. Unfortunately, these efforts are generally only marginally effective as orthopedic shoes albeit made with generally softer materials and thicker, softer outsoles are still mass-produced and the unique needs of the individual are still ignored.

Some mainstream footwear companies have realized the need for more precise fitting and now produce footwear in different widths to somewhat accommodate the different foot shapes that are prevalent.

Along the same lines, most athletic shoe companies now produce shoes which fall into three classifications. However, the presence of the three different athletic shoe types is generally misunderstood and ignored except by the even most experienced shoe salesperson and the serious and professional athlete.

The three different athletic shoe classifications are based on the fact that the human foot can be initially subdivided into three major classifications based on arch type. The three classifications are "flat planus foot" or low arched foot, a regular arched foot and a high arched or "cavus foot".

There are inherent differences in the resulting gait (walking) cycle of each foot type and the associated problems and special footwear needs as a result.

A high arch foot, also referred to as a "pes cavus" foot features an extremely elevated arch. These feet are "supinated" with the heel and toes turning slightly inward and are usually rigid or semi rigid. The resulting poor shock absorption can lead to repetitive stress problems, including pain in the knees, hips and lower back. Foot problems often develop in the heel and forefoot such as plantar fasciitis, arch strain, metatarsalgia and claw toes.

Medium or normal arch feet have a higher arch than a flat foot. Individuals with medium arch feet are usually biomechanically efficient. However, individuals with medium arches are still susceptible to pain and other problems as a result of everyday stress and strain.

The definition of low arch feet or "pes planus" is a condition where the arch is reduced or not present and the entire soles of the feet touch the ground. Low arch feet are typically flexible, over-pronated feet in which the foot rolls inward and the arch collapses under the weight of the body. As a result, over pronation often leads to plantar fasciitis heel spurs, medial knee discomfort, posterior tibial tendonitis (shin splints) and/or bunions.

However, these are just general classifications based on arch height and the exact 3D anatomy and resulting biomechanics as well as the problems that go with them are as unique as an individual's personality.

The different types of footwear themselves can be as diverse as the feet they surround, ranging from high heel shoes, to high top sneakers to steel toed safety boots and everything in between. Each style brings with it a certain level or lack of comfort, cushioning, shock absorption, support and motion control. Even then it is limited and not customized to the individuals needs.

The only alternative to mass produced footwear to accommodate for the different biomechanics inherent in different foot types is custom made footwear. Besides the fact that different types of footwear have different levels of built in cushioning and support, the human foot also changes. Age, pregnancy or any substantial weight loss or gain, other systemic medical conditions or even trauma can also cause the foot to change or function differently which would then require different levels of cushioning and support.

However, custom made footwear is very expensive due to the labor involved in their manufacturing process and a pair of custom made shoes can usually cost between 600-1200 dollars. Custom made footwear is usually prescribed only for extremely deformed feet and it is the insole inside which addresses any biomechanical deficiencies for in addition to sacrificing style, the expense involved in making custom footwear is not adaptable and the expense involved is just not practical for the mass population.

The "insole" is the most important interface between the foot or body and the shoe. It is believed that as much as 80% of the level of "comfort" perceived by the wearer of a shoe may be attributed to the insole. Until recently, most shoes were made with a totally flat inner sole or sock liner which provided little or no comfort, shock absorption or support.

In the last 10-15 years, some footwear manufacturers have started to distribute shoes with a basic contoured insert providing for minimal arch support and cushioning but most manufacturers have focused rather on improving the midsole or outsole. By using these two parts of the footwear, that is the midsole and outsole, that manufacturers have also been able to introduce and hype various marketing gimmicks, such as the "pump". At the same time, the insole has for the most part gone neglected. The footwear companies have no desire to improve or enhance the insoles that are found inside their footwear as there is no monetary gain to be had due to the fact that the insole has gone neglected for so long, the public has accepted the fact that in order to achieve any serious degree of shock absorption acceptance of after market foot inserts are required.

Market foot inserts fall into two categories; soft cushioning insoles and hard supportive insole/orthotics. The customer is forced to choose between the two types of products and as a result can not get optimal shock absorption and support at the same time. Both types of insoles are usually mass produced and there is very little customization available. This can be problematic, especially when mass produced, one-model, fits-all, harder type, orthotic insoles are sold to the general public, as this type of product can be contra-indicated with the rigid high arch foot type and with certain biomechanical conditions.

The solution of trying to accommodate for different foot types and foot mechanics by using custom-made orthotic device creates similar problems and disadvantages as with custom made footwear. A pair of custom made biomechanical foot orthoses can usually cost anywhere between 250-750 dollars. True custom made foot orthotics have been found to be indicated for less than ten percent of those suffering from foot problems and as a result are not practical for the general population. As the cost of health care continues to rise, insurance companies, employers and individuals are looking for a more cost effective yet customizable solution. The solution lies in utilizing a series of inexpensive semi-rigid arch supports using different angulations and/or material durometers (hardness) and wedges to achieve different levels of support and motion control.

A method of laminating shoe inserts from thermoplastic foam is described in U.S. Pat. No. 4,823,483 to Chapnick.

Various insoles have been developed in order to cater for specific needs, such as described in U.S. Pat. No. 6,481,120 to Xia et al., which is particularly suited to persons suffering from arthritis and diabetes.

One of the disadvantages of prior art insoles is that, generally, they are person or illness specific and not adaptable by the user to suit the level of cushioning and support to suit the person.

Besides different levels of support and motion control needed by each individual due to the hard surfaces, on which the individual stands and walks, especially at the workplace, optimal comfort, cushioning and shock absorption are always required. In a perfect world, optimal cushioning and shock absorption would also be customizable.

There is therefore a need for an inexpensive, removable foot appliance with provides self customizable optimal comfort, cushioning and shock absorption and mass self customized levels of support and motion control using different re-attachable semi rigid supports and wedges.

The same holds true for custom made foot appliances. A pair of custom made biomechanical foot orthoses can usually cost anywhere between 250-750 dollars. To produce custom made footwear or foot orthoses for every type of footwear, or changing foot condition is not practical.

There is thus a need for an inexpensive removable foot appliance which provides optimal and adaptable comfort and shock absorption with re-attachable customizable levels of support and motion control.

SUMMARY OF THE INVENTION

It is an object of the present invention to provide an improved foot appliance which can provide optimal comfort and cushioning and shock absorption.

It is a further object of the present invention to provide an improved foot appliance which can provide optimal comfort and shock absorption that is self customizable and will conform and adapt with every step of the gait cycle.

It is a yet further object of the present invention to provide an improved foot appliance which can provide additional arch support and/or additional heel support and/or additional motion control having different hardness values, as required.

It is a further object of the present invention to provide an improved foot appliance which can as a whole provide customizable optimal comfort cushioning and shock absorption while at the same time provide additional arch, heel and motion control to different levels only if and when needed.

There is thus provided in accordance in accordance with an embodiment of the invention, an orthopedic appliance, which includes a shock absorbent insole and an interchangeable support component configured to be attachable and re-attachable to the insole.

Furthermore, in accordance in accordance with an embodiment of the invention, the insole includes a trim line allowing the insole to be adapted to a three quarters length of a full insole. The three quarters length may extend form from the back of the heel to the metatarsal heads.

Furthermore, in accordance in accordance with an embodiment of the invention, the support component may be constructed from any of a group of materials including polyethylene, polypropylene and polypropylene incorporating glass or silica.

Furthermore, in accordance in accordance with an embodiment of the invention, the insole may include a groove formed within the insole, the groove being configured to incorporate a securing component adapted to be secured to the support component by means of an adhesive. The securing component may be adapted to secure the support component to the insole.

Furthermore, in accordance in accordance with an embodiment of the invention, the insole may include a plurality of layers configured to correspond to the shape and length of a user's foot.

Furthermore, in accordance in accordance with an embodiment of the invention, the plurality of layers may include an upper layer constructed from memory foam having a first thickness and first density and a lower layer constructed from memory foam having a second thickness and second density. The first density is less than the second density. The upper layer may have a density within a range of 3-12 lb/ft3 and the lower layer may have a density within a range of 13-25 lb/ft3.

Memory foam self customizes to the shape of the foot with every footstep and in an embodiment of the invention, two layers are utilized, to provide dynamic impact compression that rebounds with each step of the walking cycle. The durometer or Shore C Hardness of the lower layer memory foam may be between 20-35.

Furthermore, in accordance in accordance with an embodiment of the invention, the insole further may include a third protective layer disposed on top of the upper layer. The upper layer may be composed of one of a group of materials including silicone, latex, neoprene, Plastizote, Poron, ethylene vinyl acetate (EVA), polyethylene (PE) foam, polyurethane (PU) foam.

Furthermore, in accordance in accordance with an embodiment of the invention, the thickness of the lower layer may be thicker in the arch area and heel area relative to the forefoot area of the user's foot, thereby providing extra support and cushioning (shock absorption) to the user's arch and heel.

The upper layer may be bound to the lower layer by heat sensitive adhesive.

Additionally, in accordance in accordance with an embodiment of the invention, the upper layer and the lower layer may include a single uniform layer of cushioning material and the single uniform layer may be configured to be flat or molded to the user's foot. The upper layer is composed of one of a group of materials including silicone, latex, neoprene, plastizote, Poron, ethylene vinyl acetate (EVA), polyethylene (PE) foam, polyurethane (PU) foam.

Furthermore, in accordance in accordance with an embodiment of the invention, the support component may be disposed to extend along three quarters of the user's foot as far as the metatarsal heads.

Furthermore, in accordance in accordance with an embodiment of the invention, the support component may be configured to have a Shore® durometer hardness value in the range of 45D to 95D.

Furthermore, in accordance in accordance with an embodiment of the invention, the support component further may include a secondary support component suitably attached to the support component, the secondary support component configured to be wedge-shaped. The heel and arch support and the secondary support component may include a composite element.

The heel and arch support and the secondary support component may be constructed from any of a group of materials including polystyrene, PVC, fiberglass or graphite and polypropylene plastic.

Furthermore, in accordance in accordance with an embodiment of the invention, the support component may include a heel portion configured to fit around the heel portion of the insole.

Additionally, an aperture may be formed within the insole, thereby configuring the insole to provide shock absorption around the heel of the user.

Furthermore, in accordance in accordance with an embodiment of the invention, the support component may include an arch support portion configured to match the arch portion of the insole, thereby providing an extra supportive layer between the insole and the footwear.

Additionally, in accordance in accordance with an embodiment of the invention, the wedge-shaped portion of the secondary support component is configured to match the physiological motion of the subtalar joint during heel contact. The wedge-shaped portion may have a 4 degree varus wedge.

BRIEF DESCRIPTION OF THE DRAWINGS

The present invention will be understood and appreciated more fully from the following detailed description taken in conjunction with the appended drawings in which.

DESCRIPTION OF THE PRESENT INVENTION

Figure 1:
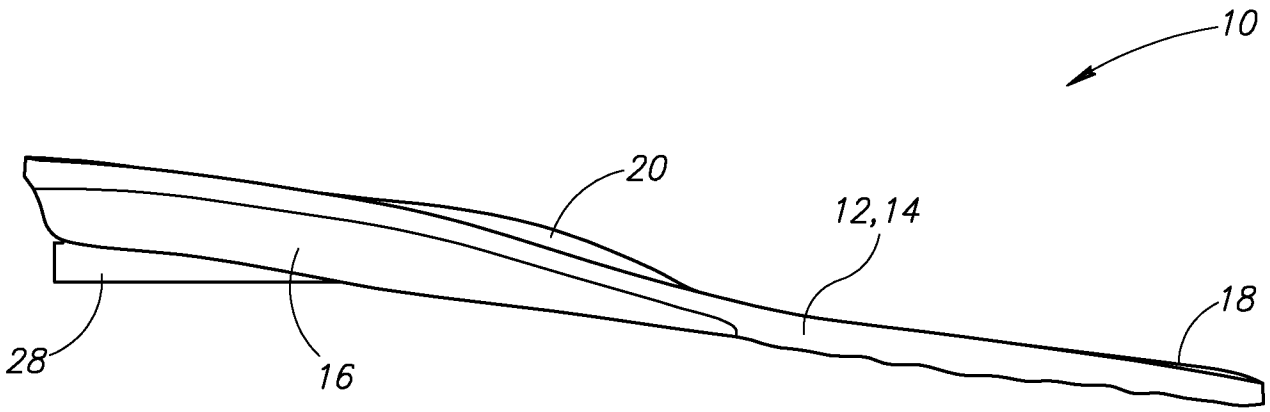
FIG. 1 a side elevational view of an orthopedic foot appliance, constructed and operative in accordance with a preferred embodiment of the present invention.
Figure 2:
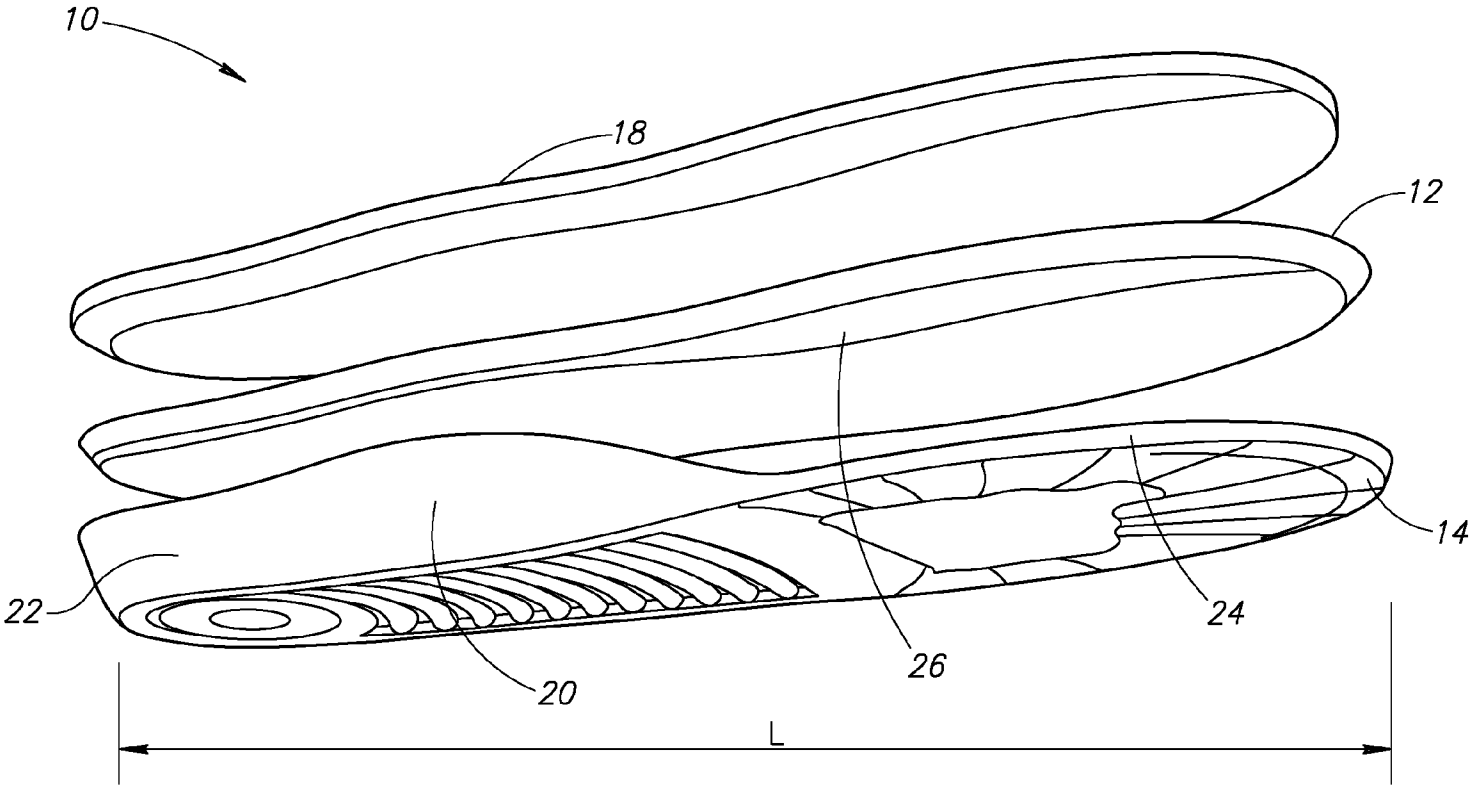
FIG. 2 is an exploded view illustrating the component layers of the orthopedic appliance of FIG. 1.

Reference is now made to FIGS. 1 and 2. FIG. 1 is a side elevational view of the orthopedic appliance 10, constructed and operative in accordance with a preferred embodiment of the present invention. FIG. 2 is an exploded view illustrating the component layers of the orthopedic appliance 10.

In accordance with an embodiment of the present invention, the orthopedic appliance 10 comprises a multi-layer orthopedic foot appliance which provides comfort, cushioning and shock absorbency as well as support.

Orthopedic appliance 10 comprises a dual layer insole 12, 14 (best seen in FIG. 2) and a support component, generally designated 16. Optionally, In accordance with embodiment of this invention, an anti-fungal, anti-microbial, anti-sweat top cloth 18 may be laminated to the top layer of the insole 12.

The dual layer insole 12, 14 provides comfort, cushioning and shock absorbency while the support component 16, which may be attachable and re-attachable to the insole 14, may provide additional support and motion control at varying levels, as required.

The dual layer insole 12, 14 may be constructed from memory foam which extends along the entire length of the foot (L). The length (L) of the insole may be manufactured to correspond to major US and other world standard footwear sizes.

Memory foam or slow recovery foam, as is known in the art, was first developed in the early 1970's at NASA's Ames Research Center in an effort to relieve the pressure of the tremendous G-forces experienced by astronauts during lift-off and flight. Since then, memory or slow recovery foam has been used effectively in the medical industry to help alleviate pressure sores and increase patient comfort. Whereas the density of standard foam is usually under 1 $lb/ft^3$, memory foam may range from 3-25 $lbs/ft^3$. Memory foam's material cellular structure is completely different than that of regular foam. It is made up of billions of high density visco-elastic memory cells that are both temperature and weight sensitive, allowing it to become softer in warmer areas and areas of high pressure (where your body is making the most contact with the surface) and remain firmer in cooler areas (where less body contact is being made). This causes the memory foam to soften and flow to follow the exact contour of the foot during each stage of the gait cycle.

In accordance with an exemplary embodiment of this invention, the top layer 12 of the insole may consist of uniform flat layer of slow recovery sheet memory foam, such as a flat layer, 2.5 mm thick having a density of between 3-12 lb/ft3, for example. Since the top layer of the insole is the closest part of the insole to the feet and body this layer should provide for maximum comfort. How the individual perceives the comfort of the entire insole is dependent of the comfort level provided by this layer. High density memory foam due to its pressure and temperature sensitivity and it ability to compress according to the hot spots of the feet can best provide this comfort level.

A second important function of this top layer is to protect the foot against shearing forces. Shearing forces have been shown to be major aggravating factor in the formation of ulcerations especially in diabetics.

Alternative materials which may be utilized for the top layer 12 may consist of silicone, latex, neoprene, plastizote, Poron, ethylene vinyl acetate (EVA), polyethylene (PE) foam, polyurethane (PU) foam, for example, or any other cushioning material known or used by one skilled in the art and can be in any thickness and density or recovery time.

In accordance with an embodiment of this invention, an anti-fungal, anti-microbial and anti-sweat top cloth may be laminated to the top layer 12 of the insole. Various types of top cloths may be used, or alternatively, the top layer may be used without a top cloth.

In accordance with a preferred embodiment of the invention, the bottom layer of the insole 14 may consist of ultra high density, molded slow recovery memory foam, having a density of 13-25 lb/ft3, for example. The inventor has realized that the use of a molded slow recovery memory foam having an ultra high density for the bottom layer (that is, a higher density than the high density foam for the upper layer), provides an improved level of comfort, cushioning and shock absorbency for the wearer of the insole. The durometer or Shore C Hardness of the lower layer memory foam may be between 20-35, for example.

In accordance with a preferred embodiment of the present invention, the thickness of the bottom layer foam 14 may be increased in the arch area 20 and heel area 22 relative to the forefoot area 24. The increased thickness allows for extra support and cushioning (shock absorption) where required, while the relatively thinner area allows for toe clearance which may be needed in certain types of footwear.

In a preferred embodiment of the invention, the upper layer 12 may be formed in sheets or slabs and skived to a uniform thickness while the lower layer 14 is molded foam which enables the thicknesses to be varied.

In accordance with an embodiment of the invention, the top layer of the insole 12 may be bound to the bottom layer 14 using a heat sensitive adhesive, known in the art, attached to the underside of the top layer 26. As will be appreciated by persons knowledgeable in the art, the top layer 12 may also be bound to the bottom layer 14 by any other suitable adhesion means.

In an alternative embodiment of the present invention, the insole 12, 14 may consist of a single uniform layer of cushioning material, either flat or molded instead of two or dual layered insole (described hereinbefore). Furthermore, in an embodiment of the invention, the insole may be three quarters in length extending as far as the metatarsal heads.

The single layer insole may consist of any material or comfort cushioning and shock absorbing material combination known or used by one skilled in the art such as silicone, latex, neoprene, plastizote, poron, EVA, PE foam or PU foam, for example, but is not limited thereto.

In accordance with an embodiment of the invention, a secondary support component, configured to have a wedge shape 28 may be suitably attached to the re-attachable support component 16. As will be appreciated by persons knowledgeable in the art, the shape of the secondary support component is not limited to a wedge shape, but may be configured to any shape which may be attachable to the support component 16

In accordance with an embodiment of the invention, the heel 22 and arch support and wedging piece 28 may be configured to comprise a re-attachable one piece support, constructed from polypropylene plastic, for example.

Polypropylene is an exemplary material since it is rigid enough to support the weight of an active, full grown adult but at the same time retains enough flexibility to allow the foot to work naturally and comfortably. Polypropylene has several advantages, generally providing a strong, durable and thin layer of support for the foot and body without reducing the space for the foot itself. Furthermore, polypropylene is known as a recyclable material.

In an alternative embodiment of the invention, the re-attachable support and wedging pieces may me made from different materials such as polyethylene, for example, having varying thicknesses and/or durometers (measure of hardness) known in the art.

By varying the value of the hardness and/or thickness of polypropylene or any other material, the level of support can be increased or decreased accordingly.

Figure 3:
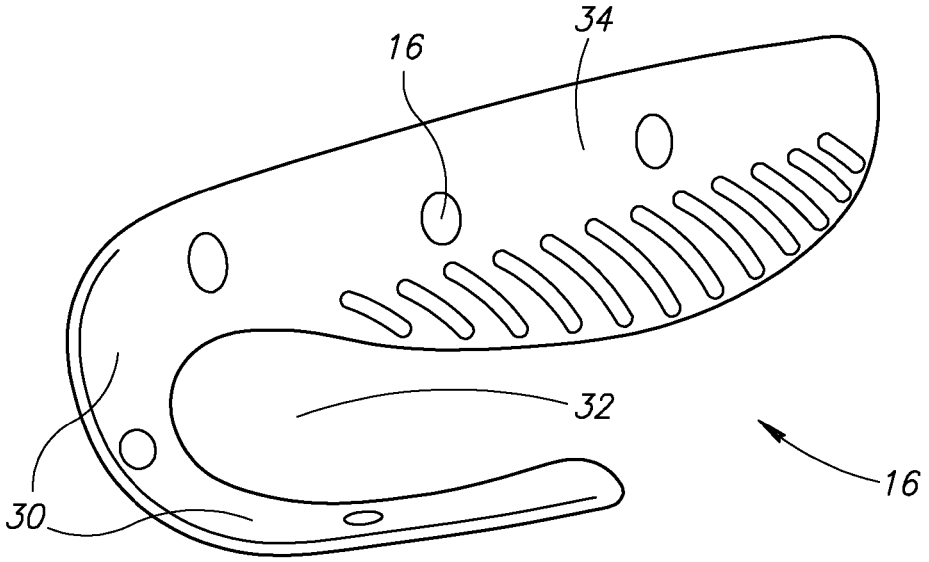
FIG. 3 is a top view elevation of the re-attachable support component of the orthopedic foot appliance of FIG. 1.

Reference is now made to FIG. 3, which is a top view elevation of the re-attachable support component 16. In accordance with an embodiment of this invention, the heel portion 30 of the re-attachable support component 16 fits snuggly around the heel portion of the insole 14.

The contour of the heel portion 30 of the support component 16 may be configured to exactly match the contour and/or grooves of the insole providing a supportive bed for the heel portion of the insole to sit in and an extra supportive layer between the insole and the heel counter of the footwear.

An aperture 32 may be formed in plastic (for example) matching the inner circle of the design pattern and groove of the insole corresponding to the central bony area of the heel bone. The aperture 32 allows the cushioning material of the insole to provide optimal shock absorption necessary for heel strike, without aggravating any 'boney' conditions under the heel bone.

In accordance with an embodiment of the invention, the arch support portion 34 of the re-attachable component 16 fits snuggly against the arch portion 20 of the insole. The contour of the arch portion may be configured to exactly match the contour and/or grooves of the insole providing an extra supportive layer between the insole and the footwear also accentuating the built in arch support of the footwear.

In accordance with an embodiment of the invention, the support component 16 may have a Shore® Durometer (hardness) value in the range of 45D to 95D. As will be appreciated by persons knowledgeable in the art, by varying the value of the hardness level, the amount of support can be increased or decreased accordingly.

In accordance with an embodiment of the invention, the wedge portion 28 of the re-attachable piece is a 4 degree varus wedge. The preferred degree of varus or inverted wedging is selected to best approximate the normal physiological motion of the subtalar joint during heel contact. As will be appreciated by persons knowledgeable in the art, the degree of varus wedge is not limited but may be varied to suit an individual's gait.

In an alternative embodiment of the present invention, the rear foot wedged portion of the re-attachable piece may be configured to have any suitable degree of wedging or be configured without any rear foot wedging. Changing the amount of wedging allows for different degrees of motion control.

In accordance with an embodiment of this invention, the insole 14 may be secured to the re-attachable support component 16 the by means of adhesive glue, 36, or similar, placed on the re-attachable piece 16. Adhesive glue, for example allows for the easy attachment and reattachment of the component 16.

In alternative embodiments of the present invention, the insole and the support component may be secured and re-attached by means of any suitable fixing means such as hinges, Velcro, magnets, hooks or any other fastening system, known in the art, which allows for ease of attaching and re-attaching of components.

Figure 4:
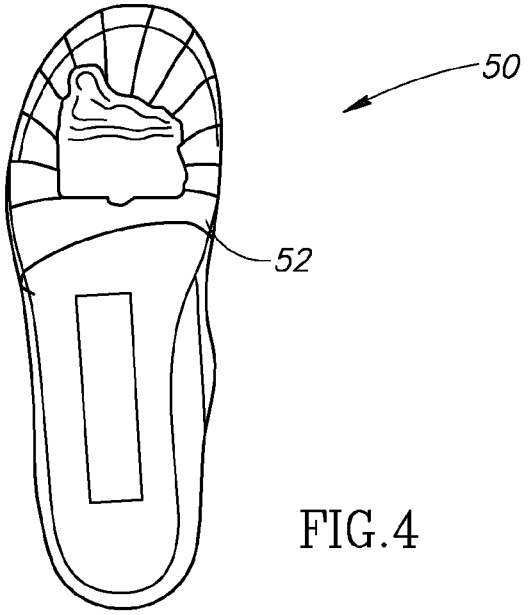
FIG. 4 a bottom view of an orthopedic foot appliance, constructed and operative in accordance with another preferred embodiment of the present invention.
Figure 5:
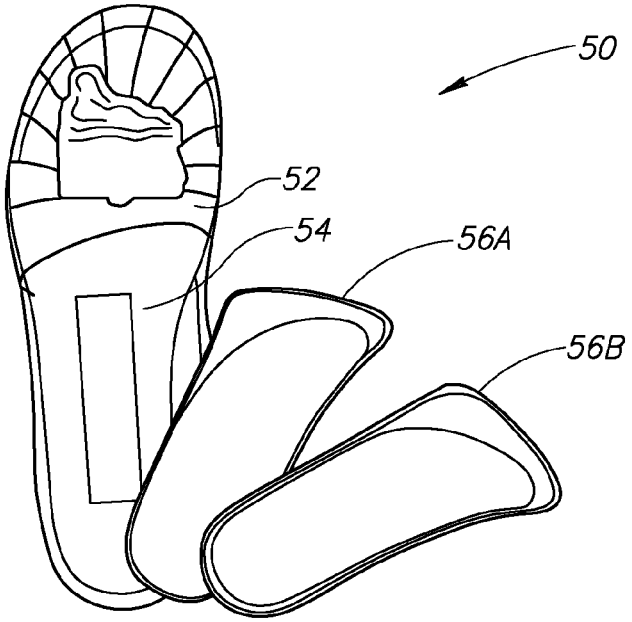
FIG. 5 is a bottom view of alternative configurations of the orthopedic foot appliance of FIG. 4.

Reference is now made to FIGS. 4 and 5, which illustrate an orthopedic foot appliance, generally designated 50, constructed and operative in accordance with another preferred embodiment of the present invention.

Orthopedic foot appliances and insoles are generally available in two lengths; full length and ¾ length. The full length goes from the back of the heel to the end of the toes, while the ¾ length extends from the back of the heel to the metatarsal heads. The ¾ length allows toes to move freely and fits easily in a greater variety of footwear and are therefore usually worn in casual or dress shoes where there is little or no room in the toe area.

At present, retailers are required to stock both types of insoles and have a double inventory. Customers need to make a choice between a full or ¾ length at the point and time of purchase.

The orthopedic foot appliance 50 comprises a dual layer insole (similar to the insole of FIG. 2) having a trim line 52 and comprising an interchangeable support component 56A, 56B. The trim line 52 allows the use to insole to be adapted to provide a ¾ length insole, by trimming along the line 52.

In the preferred embodiment of FIGS. 4 and 5, the orthopedic foot appliance 50 may be supplied with different levels of support pieces 56A and 56B. For example, support piece 56A may be constructed from polyethylene or polypropylene for medium support and support piece 56B may be constructed from polypropylene incorporating 10% of glass or silica for even firmer support. Alternatively, the orthopedic foot appliance 50 may be used without any of the support pieces if desired.

The support component 56A, 56B is re-attachable to the insole by Velcro™ strip 54, for example and provides additional support and motion control at varying levels, as required.

The insole may be configured with a groove formed within the insole. The Velcro™ strip 54 may be secured to the insole using an adhesive for example. A corresponding Velcro™ strip (not shown) may be similarly fixed to the support pieces 56A and 56B, for securing the support pieces to the insole.

In this embodiment, the support pieces are configured as a single piece heel and arch support to match the contours of the insole.

Thus, in contrast to the present situation, orthopedic foot appliance 50 having a ¾ trim line as part of the design of the insole enables distributors and retailers to only hold one inventory item per size. Furthermore, consumers can now choose after purchase, depending on their foot type, footwear and activity, what length of insole they prefer, that is full length or ¾ length.

It will be further appreciated that the present invention is not limited by what has been described hereinabove and that numerous modifications, all of which fall within the scope of the present invention, exist. Rather the scope of the invention is defined by the claims, which follow:

What is claimed is:

1. An orthopedic appliance for use by a person comprising:

a full length shock absorbent insole; and a support component configured to be attachable and reattachable to the underside of said insole by any of hinges, fabric hook and loop fasteners, magnets or hooks, wherein said support component is configured to be detachable from said insole and be replaced with another support component having a different durometer hardness value, and wherein said insole comprises dual layers, said dual layers configured to correspond to the shape and substantially the full length of the insole, said dual layers having an upper layer constructed from slow recovery memory foam comprising of high density visco-elastic memory cells and having a first thickness and first density, and a lower layer constructed from slow recovery memory foam comprising high density visco-elastic memory cells and having a second thickness and second density, wherein said first density is within a range of 3-12 lb/ft$^3$ and said second density is within a range of 13-25 lb/ft$^3$, wherein said support component is configured to have a durometer hardness value in the range of 45D to 95D, and wherein said lower layer is molded from slow recovery memory foam having a hardness in the range of 20C-35C.

2. The orthopedic appliance of claim 1, wherein said upper layer is formed in sheets or slabs to a uniform thickness.

3. The orthopedic appliance of claim 1, wherein said insole further comprises a third protective layer disposed on top of said upper layer.

4. The orthopedic appliance of claim 1, wherein said upper layer is composed of one of a group of materials including silicone, latex, polychloroprene plastizote, ethylene vinyl acetate (EVA), polyethene (PE) foam, polyurethane (PU) foam.

5. The orthopedic appliance of claim 1, wherein the thickness of said lower layer is thicker in the arch area and heel area relative to the forefoot area of the user's foot, thereby to provide extra support and cushioning to the user's arch and heel.

6. The orthopedic appliance of claim 1, wherein said upper layer is bound to said lower layer by heat sensitive adhesive.

7. The orthopedic appliance of claim 1, wherein said upper layer and said lower layer comprises a single uniform layer of cushioning material and wherein said single uniform layer is configured to be flat or molded to the user's foot.

8. The orthopedic appliance of claim 7, wherein said upper layer is composed of one of a group of materials including silicone, latex, polychloroprene plastizote, ethylene vinyl acetate (EVA), polyethene (PE) foam, polyurethane (PU) foam.

9. The orthopedic appliance of claim 1, wherein said support component further comprises a secondary support component suitably attached to said support component, said secondary support component configured to match the physiological motion of the subtalar joint during heel contact.

10. The orthopedic appliance of claim 1, wherein said heel and arch support and said secondary support component comprise a composite element.

11. The orthopedic appliance of claim 1, wherein said heel and arch support and said secondary support component is constructed from any of a group of materials including polystyrene, polymerizing vinyl chloride (PVC), glass-reinforced plastic or graphite and polypropylene plastic.

12. The orthopedic appliance of claim 1, wherein said support component comprises a heel portion configured to fit around the heel portion of the insole.

13. The orthopedic appliance of claim 1, wherein an aperture is formed within said support component, thereby configuring said support component allows the cushioning material of the insole to provide shock absorption around the heel of the user.

14. The orthopedic appliance of claim 1, wherein the support component comprises an arch support portion configured to match the arch portion of the insole, thereby providing an extra supportive layer between the insole and the footwear.

15. The orthopedic appliance of claim 1, wherein said insole is adapted to a three quarters length of a full insole from the back of the heel to the metatarsal heads.

16. An orthopedic appliance, comprising:

a shock absorbent insole having dual layers, said dual layers configured to correspond to the shape and substantially the full length of the insole, said dual layers having an upper layer constructed from slow recovery memory foam comprising high density visco-elastic memory cells and having a first thickness and first density, and a lower layer constructed from slow recovery memory foam comprising high density visco-elastic memory cells and having a second thickness and second density, wherein said first density is within a range of 3-12 lb/ft$^3$ and said second density is within a range of 13-25 lb/ft$^3$, wherein said lower layer is molded from slow recovery memory foam having a hardness in the range of 20C -35C.

17. The orthopedic appliance of claim 16, further comprising:

a support component configured to be attachable and reattachable to said insole by any of hinges, fabric hook and loop fasteners, magnets or hooks.

18. The orthopedic appliance of claim 17, wherein said support component is configured to be detachable from said insole and be replaced with another support component having a different durometer hardness value.

* * * * *